US007167662B2

(12) United States Patent
Walgrove, III et al.

(10) Patent No.: US 7,167,662 B2
(45) Date of Patent: Jan. 23, 2007

(54) CONDUCTIVE BRUSH CLEANER FOR A TRANSFER ROLLER

(75) Inventors: George R. Walgrove, III, Rochester, NY (US); Gary B. Bertram, Honeoye Falls, NY (US); Ronald Auty, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/038,660

(22) Filed: Jan. 19, 2005

(65) Prior Publication Data

US 2005/0214020 A1 Sep. 29, 2005

Related U.S. Application Data

(60) Provisional application No. 60/556,144, filed on Mar. 25, 2004.

(51) Int. Cl.
*G03G 15/16* (2006.01)

(52) U.S. Cl. ..... 399/101

(58) Field of Classification Search ..... 399/101, 399/98, 99, 353

See application file for complete search history.

(56) References Cited

U.S. PATENT DOCUMENTS

| | | | | |
|---|---|---|---|---|
| 4,835,807 A | | 6/1989 | Swift | |
| 4,912,516 A | | 3/1990 | Kaieda | |
| 4,998,143 A | | 3/1991 | Kumasaka et al. | |
| 5,101,238 A | | 3/1992 | Creveling et al. | 355/271 |
| 5,233,394 A | * | 8/1993 | Fujita et al. | 399/101 |
| 5,937,254 A | | 8/1999 | Maher et al. | 399/297 |
| 6,009,301 A | | 12/1999 | Maher et al. | 399/353 |
| 6,074,756 A | | 6/2000 | Vreeland et al. | 428/423.1 |
| 6,381,427 B1 | | 4/2002 | Bertram et al. | 399/101 |
| 6,549,747 B2 | * | 4/2003 | Brown et al. | 399/353 |
| 6,970,666 B2 | * | 11/2005 | Takahashi et al. | 399/101 |

FOREIGN PATENT DOCUMENTS

| | | | |
|---|---|---|---|
| JP | 58 111077 | | 9/1983 |
| JP | 62-215283 | * | 9/1987 |
| JP | 62 215283 | | 3/1988 |
| JP | 11 024421 | | 4/1999 |

* cited by examiner

*Primary Examiner*—Quana Grainger
(74) *Attorney, Agent, or Firm*—Justin D. Pettrvzzelli

(57) ABSTRACT

An electrophotographic machine includes a dielectric member carrying a toner image. A biased transfer roller engages the dielectric member and transfers the toner image to an image substrate. A cleaning brush having a plurality of bristles, at least some of which are electrically conductive, engages the transfer roller. An electrically conductive housing encloses the cleaning brush. The bristles contact the transfer roller through an opening in the housing. At least one of the cleaning brush and the housing is biased to substantially the same electrical potential as the transfer roller.

9 Claims, 7 Drawing Sheets

CONDUCTIVE BRUSH CLEANER FOR A TRANSFER ROLLER

CROSS-REFERENCE TO RELATED APPLICATIONS

This application claims the benefit of U.S. Provisional Patent Application No. 60/556,144, filed Mar. 25, 2004.

FIELD OF THE INVENTION

The present invention relates generally to electrophotographic printing and/or copying machines. More particularly, the present invention relates to a method and apparatus for cleaning the transfer roller in such machines.

BACKGROUND OF THE INVENTION

In modern high-speed/high-quality electrophotographic machines, such as copiers and printers, a latent image charge pattern is formed on a dielectric member, such as an endless-loop belt. Pigmented toner particles are drawn by electrostatic attraction onto the latent image charge pattern to develop the image carried on the dielectric member. A receiver sheet or image substrate, such as, for example, a piece of paper, is then brought into contact with the image on the support member. An electric field is applied to transfer the image from the support member to the image substrate. Thereafter, the image substrate carrying the transferred image is separated from the dielectric support member and the image is fixed to the substrate, such as, for example, by fusing.

One way in which the electric field is applied to effect transfer of the image from the support member to the image substrate is the use of a roller-type transfer station or sub-system wherein a transfer roller is in engagement with the dielectric member. The transfer roller is electrostatically biased and causes the transfer of the charged toner particles from the surface of the dielectric member to the image substrate as the image substrate passes between the transfer roller and the dielectric member. During operation, however, residual toner and other particulate material, such as paper dust, is sometimes picked up by and/or attracted to the biased transfer roller. These particles can be transferred onto the back surface of the next image substrate and create undesirable marks thereon. Therefore, the transfer roller is continuously and automatically cleaned by a cleaning mechanism.

The cleaning mechanism is typically an elongate cylindrical fiber cleaning brush, and is electrically non-conductive. The cleaning brush and transfer roller are generally in relatively close proximity with parallel central axes. The fiber cleaning brush engages the surface of the transfer roller with a force that is calculated to achieve relatively efficient cleaning of the transfer roller surface. A motor drives the cleaning brush to rotate in the area of contact between the cleaning brush and the transfer roller in a direction opposite to the direction in which the transfer roller is rotated, and thereby increases the effectiveness with which the cleaning brush removes particles from the surface of the transfer roller.

Despite the above-described measures to improve the effectiveness with which the cleaning brush removes or cleans the transfer roller, a typical cleaning brush is relatively inefficient and requires multiple passes in order to clean even a moderately contaminated roller. A conventional cleaning brush may typically have a maximum cleaning efficiency of less than approximately ten percent.

Therefore, what is needed in the art is a transfer roller cleaning brush having an improved cleaning efficiency.

SUMMARY OF THE INVENTION

The present invention provides a method and apparatus for cleaning a transfer roller in an electrophotographic machine.

The invention comprises, in one form thereof, an electrophotographic machine having a dielectric member carrying a toner image. A biased transfer roller engages the dielectric member and transfers the toner image to an image substrate. A cleaning brush having a plurality of bristles, at least some of which are electrically conductive, engages the transfer roller. An electrically conductive housing encloses the cleaning brush. The bristles contact the transfer roller through an opening in the housing. At least one of the cleaning brush and the housing is biased to substantially the same electrical potential as the transfer roller.

An advantage of the present invention is that the efficiency with which the transfer roller is cleaned is improved.

Another advantage of the present invention is that a conductive cleaning brush is used to clean the transfer roller without substantially reducing image transfer current thereby maintaining efficient image transfer and image quality.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
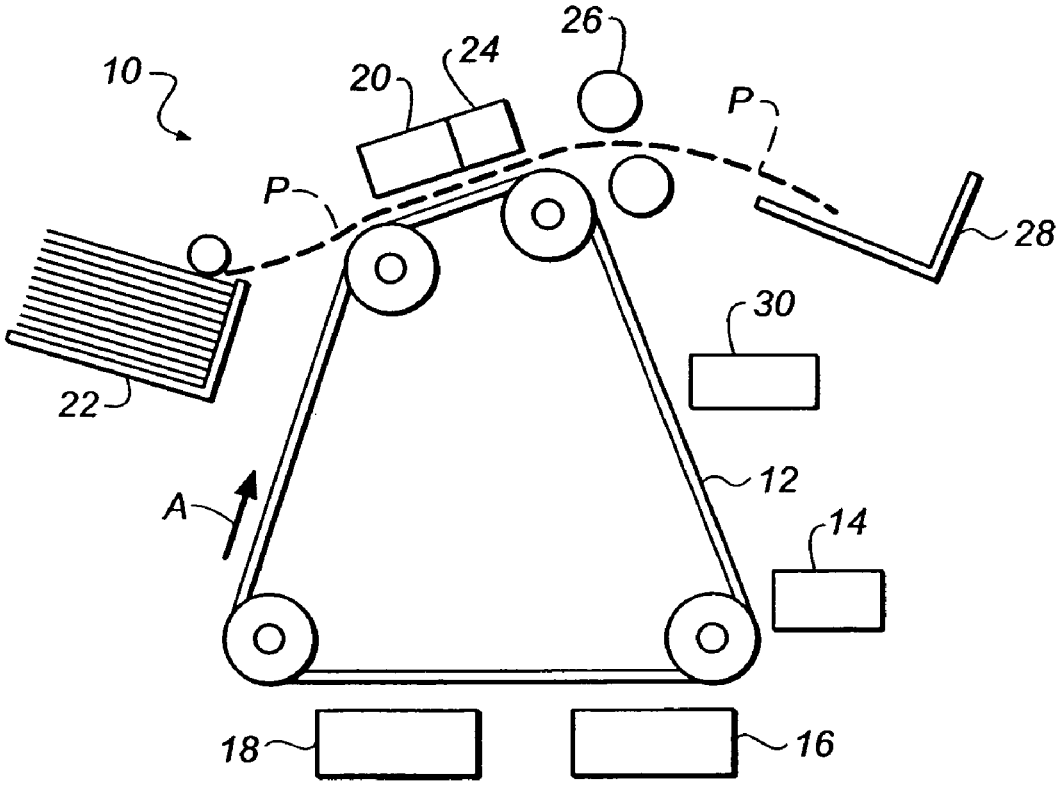
FIG. 1 (PRIOR ART)
FIG. 1 is a schematic illustration of a typical electrophotographic machine.

Referring now to FIG. 1, a schematic diagram of a conventional electrophotographic machine is shown. Machine 10, such as, for example, a copier or printer, includes dielectric member 12, charging station 14, exposure station 16, development station 18, transfer station 20, paper supply 22, paper detach mechanism 24, fusing station 26, output hopper 28, and cleaning station 30.

Generally; in use, machine 10 moves dielectric support 12 past and/or through charging station 14 wherein a uniform charge is applied thereto. Dielectric support 12 is thereafter moved past and/or through exposure station 16 wherein the uniform charge is altered to form a latent image charge pattern (not shown) corresponding to the information desired to be printed and/or reproduced. The latent image charge pattern is carried by dielectric member 12 into development station 18, wherein pigmented marking particles (i.e., toner) are brought into close association with and electrostatically drawn to the latent image charge pattern thereby creating a developed image on dielectric member 12. Transfer station 20 generates an electric charge to transfer the toner of the developed image carried on dielectric member 12 to an image substrate, such as, for example, a piece of paper, fed from hopper 22 into and through transfer station 20 along path P. Detach mechanism 24 facilitates removal of the image substrate from dielectric member 12. Fusing station 26 fixes the toner particles to the image substrate by, for example, heat and/or pressure, and delivers the image substrate to output hopper 28. The dielectric support 12 is then cleaned by cleaning station 30.

Figure 2:
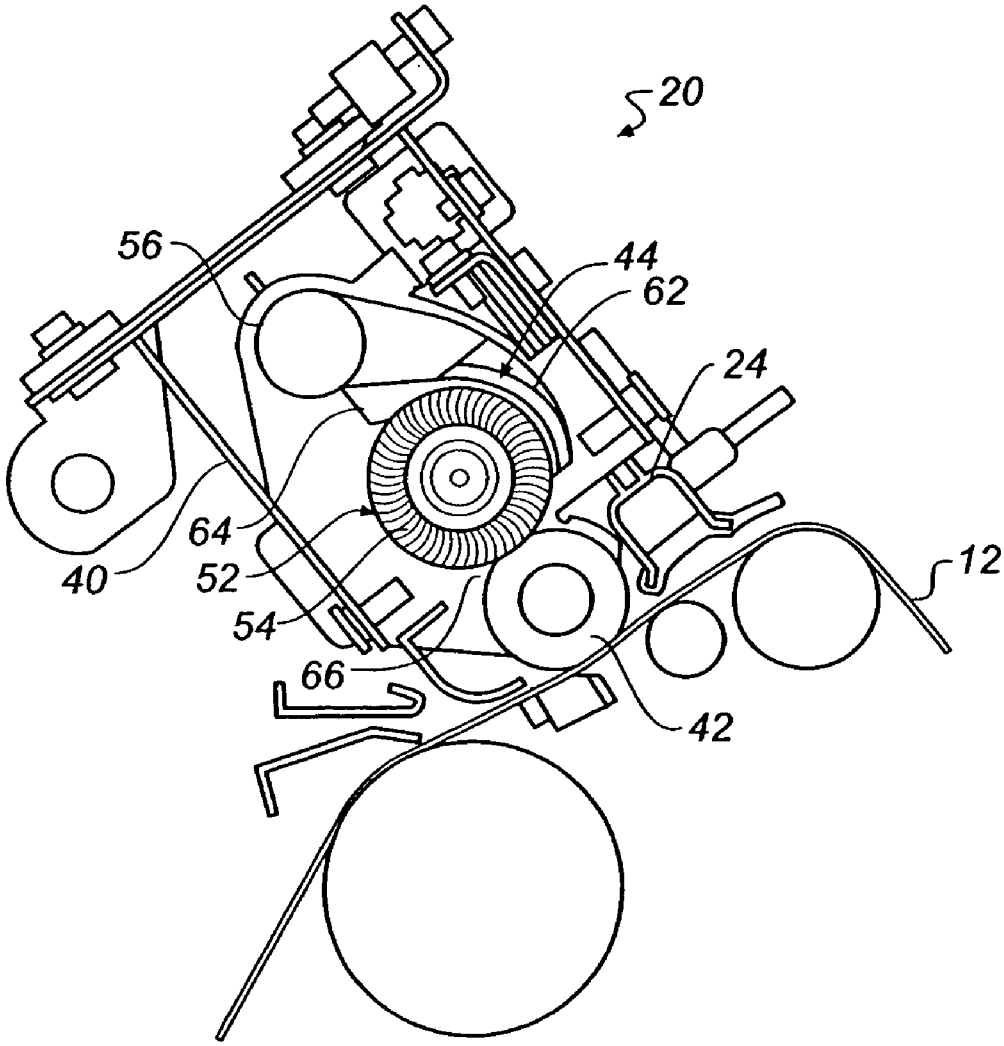
FIG. 2 (PRIOR ART)
FIG. 2 is a side view of a roller transfer station or sub-system of the electrophotographic machine of FIG. 1.

Referring now to FIG. 2, the roller transfer station or sub-system 20 of electrophotographic machine 10 is shown in more detail. Roller transfer station 20 includes a housing 40 within which is disposed a transfer roller 42 and a roller cleaning mechanism 44. In the embodiment shown, detach mechanism 24 is also disposed within housing 40.

Transfer roller 42 engages dielectric member 12. An electrical bias is applied to the conductive core (not referenced) of transfer roller 42 by a power supply (not shown), such as, for example, a voltage-limited constant current source power supply. The electrical bias establishes the above-described electrical transfer field that will efficiently transfer a developed image from the dielectric member to a receiver member passing between dielectric member 12 and the semi-conductive surface (not referenced) of transfer roller 42. When the outer surface of transfer roller 42 contacts dielectric member 12 with no image substrate in between, transfer roller 42 tends to pick up and/or attract residual toner and/or paper dust/particles from dielectric member 12. Transfer roller 42 may be more severely contaminated when a misfeed of an image substrate occurs. In such an instance, virtually the entire developed toner image will be transferred from the dielectric member 12 to the outer surface of transfer roller 42. The residual toner and other contaminant particles can be transferred from transfer roller 42 onto the back side/surface of the next image substrate to be processed through roller transfer station 20 and thereby form undesirable marks thereon. Therefore, transfer roller 42 is cleaned by cleaning mechanism 44 which removes the residual toner and/or paper dust particles and thereby prevents the deposition thereof onto the back sides of the image substrates.

Cleaning mechanism 44 includes an elongated, cylindrical, fiber brush 52 having fiber bristles 54. Brush 52 is disposed within and supported by housing 40 such that the longitudinal axis (not referenced) of brush 52 is parallel to and spaced a predetermined distance apart from the longitudinal axis (not referenced) of transfer roller 42. Bristles 54 engage transfer roller 42 with a predetermined amount engagement that, dependent at least in part upon the density of brush 52 and its speed of rotation, is intended to maximize the efficiency with which brush 52 cleans transfer roller 42. Motor 56 is coupled to housing 40 and rotates brush 52 in a direction such that brush 52 and transfer roller 42 are rotating in opposite directions in the area of contact. Vacuum 62 is associated with brush 52 to remove cleaned particles from the fibers/bristles thereof, the particles being deposited in a downstream collection container (not shown).

Cleaning mechanism 44 also includes brush housing 64. Brush housing 64 is in communication with a vacuum-generating blower (not referenced), and forms an air-flow-directing chamber in close proximity to a portion of the periphery of brush 52. Brush housing 64 defines an opening 66 to brush 52 through which bristles 54 thereof engage transfer roller 42. Brush housing 64 is typically formed of a conductive plastic in order to prevent the build up of static electrical charge from the rotating brush therein and the air flow therethrough.

The foregoing is a general description of one embodiment of a conventional electrophotographic machine having one embodiment of a roller transfer station or sub-system. A more detailed description thereof is provided in U.S. Pat. Nos. 5,101,238 and 6,381,427, the disclosures of which are incorporated herein by reference.

Figure 3:
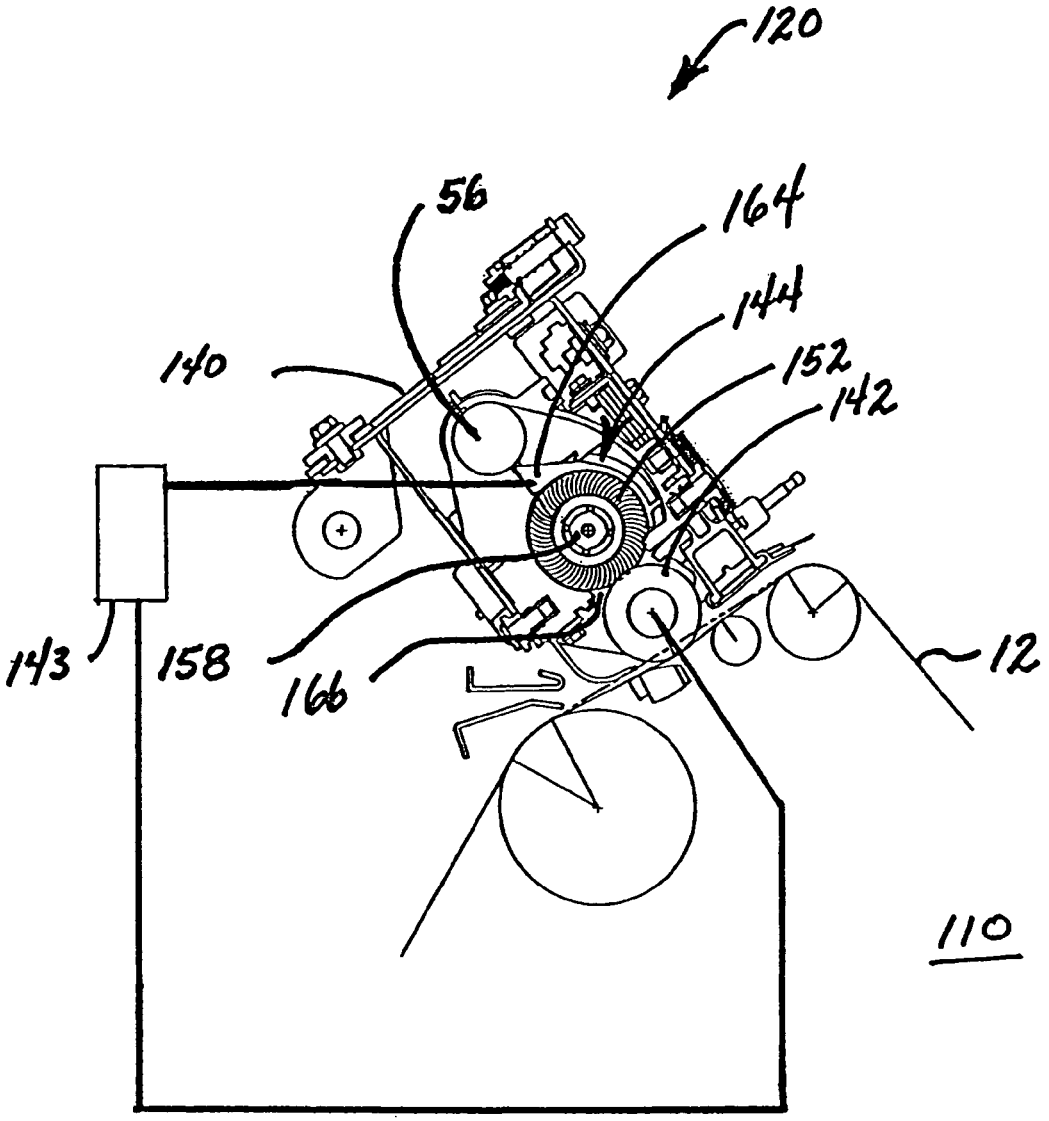
FIG. 3 is a side view of a roller transfer station or sub-system of the present invention.

Referring now to FIG. 3, an electrophotographic machine 110 including one embodiment of a roller transfer station or sub-system of the present invention is shown. Roller transfer station 120 includes several component parts that are common with and/or substantially similar to those of roller transfer station 20, and corresponding reference characters are used to indicate those corresponding parts. Roller transfer station 120 includes a housing 140 which encloses transfer roller 142 and transfer roller cleaning mechanism 144.

Transfer roller 142, much like transfer roller 42 described above, has an electrically-conductive inner core (not referenced) and a semi-conductive outer surface (not referenced), typically polyurethane, that engages dielectric member 12. The outer surface of transfer roller 142 may be coated, as described in U.S. Pat. No. 6,074,756, or uncoated. An electrical bias is applied to the conductive core of transfer roller 142 by transfer roller power supply 143, such as, for example, a voltage-limited constant current source. The electrical bias establishes the above-described electrical transfer field that transfers the developed image from dielectric member 12 to a receiver member passing between dielectric member 12 and transfer roller 142. When the outer surface of transfer roller 142 contacts dielectric member 12 with no image substrate there between, transfer roller 142 tends to pick up and/or attract residual toner and/or paper dust/particles from dielectric member 12 in much the same manner as described above in regard to transfer roller 42. These particles are removed from transfer roller 142 by cleaning mechanism 144.

Figure 5:
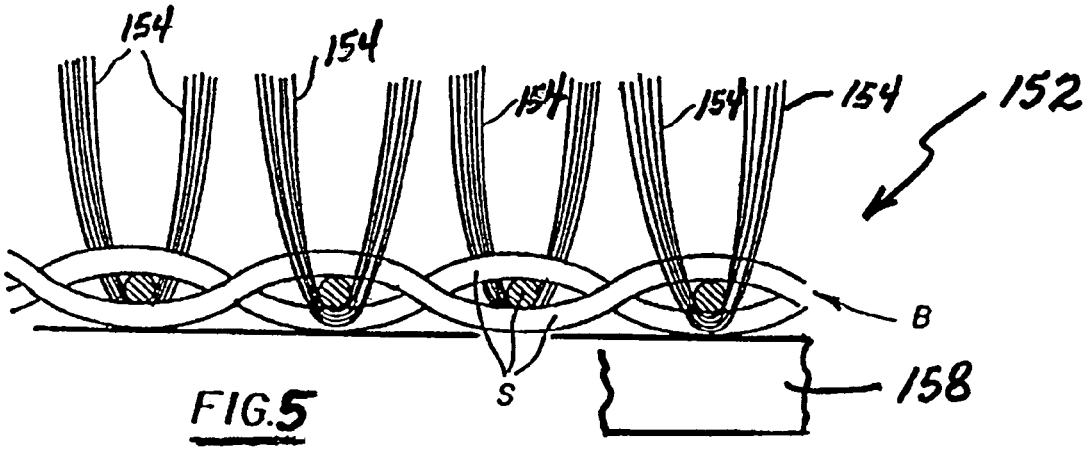
FIG. 5 is a side, elevational view of the weave of the cleaning brush of FIG. 3.
Figure 4:
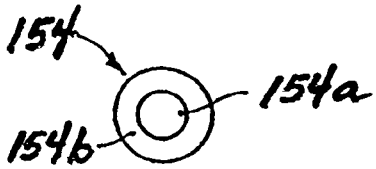
FIG. 4 is a cross-sectional view of an individual fiber of the cleaning brush of FIG. 3.

Cleaning mechanism 144 includes an elongated, cylindrical, transfer roller cleaning brush 152 having, as best shown in FIGS. 4 and 5, a plurality of electrically-conductive fibers or bristles 154 and a brush core 158. Fibers 154 are attached or otherwise connected to and extend in a generally radial direction from brush core 158. Brush core 158 is constructed of an electrically nonconductive material, such as, for example, cardboard. Transfer roller cleaning brush 152 is disposed within and supported by housing 140 such that the longitudinal axis (not referenced) of brush 152 is parallel to and spaced a predetermined distance apart from the longitudinal axis (not referenced) of transfer roller 142. Transfer roller cleaning brush 152 is electrically isolated relative to housing 140.

Cleaning mechanism 144 also includes brush housing 164. Brush housing 164, much like brush housing 64, is in communication with a vacuum-generating blower (not referenced), and forms an air-flow-directing chamber in close proximity to a portion of the periphery of brush 152. Brush housing 164 defines an opening 166 to brush 152 through which bristles 154 contact transfer roller 142. Brush housing 164 is electrically conductive and has a resistivity of, for example, from approximately $10^3$ to approximately $10^5$ ohms-cm. Generally, and as will be more particularly described hereinafter, brush housing 164 is electrically charged to the same potential as transfer roller 142.

Fibers or bristles 154 engage transfer roller 142 through an opening 166 in brush housing 164 and engage transfer roller 142 with a predetermined amount engagement that is dependent at least in part upon the density of brush 152 and its speed of rotation, and is intended to substantially maximize the efficiency with which brush 152 mechanically cleans transfer roller 142. Motor 56 is coupled to housing 140 and rotates brush 152 in a direction such that brush 152 and transfer roller 142 are rotating in opposite directions in the area of contact. A vacuum (not shown) is also associated with brush 152 and brush housing 164 to remove cleaned particles from the fibers/bristles 154, the particles being deposited in a downstream collection container (not shown).

As best shown in FIG. 4, fibers/bristles 154 of brush 152 preferably include an inner conductive central core 154*a* and a non-conductive peripheral portion 154*b* surrounding conductive central core 154*a*. One embodiment of such a brush is more particularly described in U.S. Pat. Nos. 5,937,254 and 6,009,301, the disclosures of which are incorporated herein by reference and which describe the use of such a brush in association with an intermediate transfer member. As is more particularly described therein, and as shown in FIG. 5, brush 152 is weaved into a backing strip B having fibers S, at least some of which have an electrically conductive periphery. A conductive mat is thus formed that provides a means of inductively charging and/or discharging the conductive cores 154*a* of fibers/bristles 154 without requiring an ohmic contact thereto. The conductive backing strip B is then attached, such as, for example, by epoxy, to brush core 158.

U.S. Pat. No. 6,549,747, the disclosure of which is also incorporated herein by reference, discloses a conductive cleaning brush that is associated with a biased intermediate transfer member (ITM). As described therein, the conductive brush is biased to a voltage of the same polarity as but a greater magnitude than the voltage to which the intermediate transfer member is biased, and to a polarity opposite the polarity of the toner/marking particles, in order to electrostatically draw toner and other particles from the ITM to the cleaning brush. The brush housing that encloses the conductive cleaning brush is permitted to electrically float or accumulate the charge carried by the toner/marking particles (i.e., the same magnitude and polarity), and thereby repels additional toner/marking particles.

In contrast, and as is more particularly described hereinafter, the conductive transfer roller cleaning brush of the present invention is associated with a biased transfer roller (rather than an intermediate transfer roller). Use of a conductive cleaning brush with a biased transfer roller has heretofore been problematic because contacting the transfer roller with a conductive brush creates a path through which current intended to accomplish image transfer is instead bled off from the biased transfer roller to ground thereby undesirably reducing the current available to accomplish image transfer and adversely impacting image quality. Although the amount of current sourced to transfer roller 142 can be increased to compensate for the bleed off of transfer current, doing so is an imperfect solution since the electrical load presented by transfer roller 142 and the transfer current required for quality image transfer both vary widely due to various operating conditions and parameters, such as, for example, temperature, humidity, thickness of the image substrate or paper being used, etc.

Generally, the present invention charges the conductive transfer roller cleaning brush and/or the conductive brush housing that encloses the conductive transfer roller cleaning brush to the same electrical polarity and substantially the same magnitude to which the transfer roller is charged (and to the opposite polarity as the marking particles/toner). By charging the conductive transfer roller cleaning brush and/or brush housing to substantially the same magnitude and polarity as the transfer roller the present invention substantially reduces and/or eliminates the image-degrading flow of transfer current away from the transfer roller.

Figure 6:
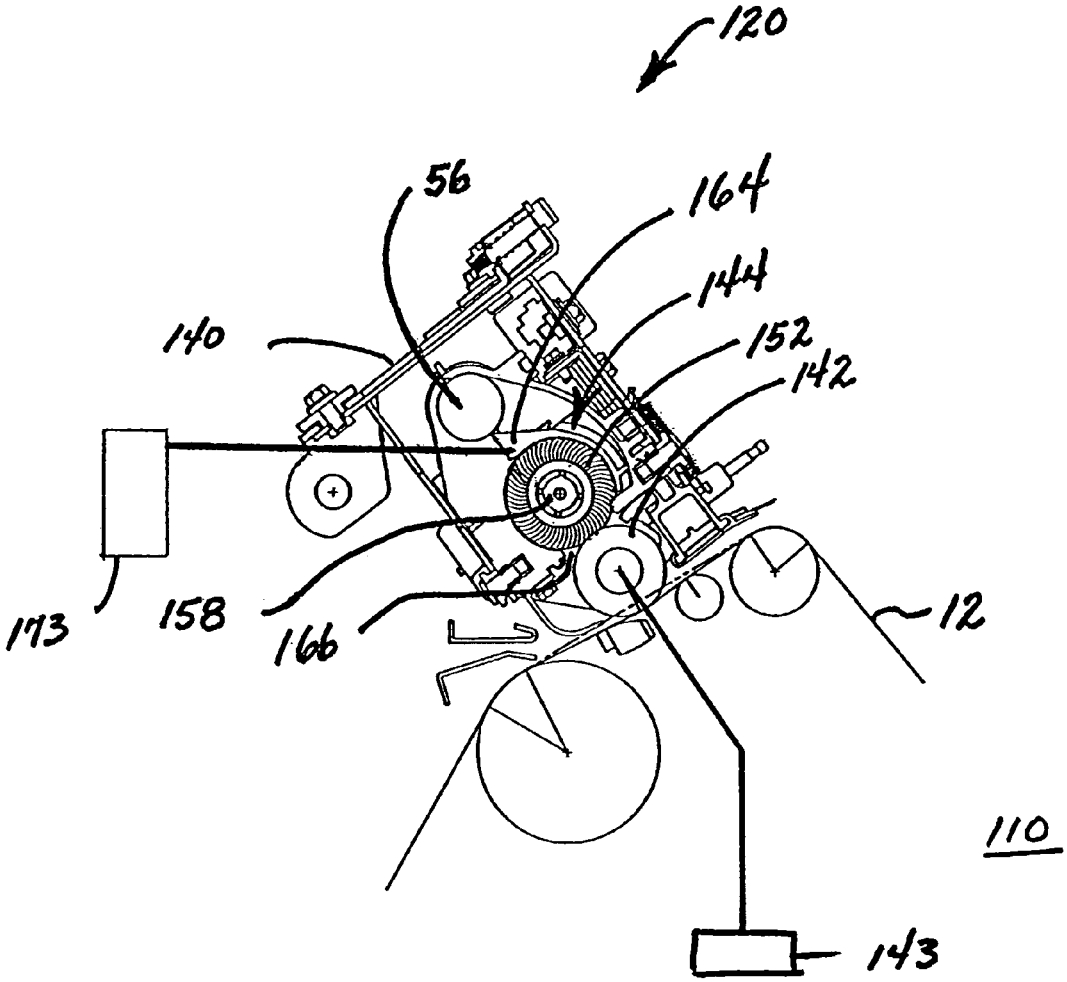
FIG. 6 is a side view of a second embodiment of a roller transfer station or sub-system of the present invention.

Referring again to FIG. 3, conductive brush housing 164 of roller transfer station 120 is electrically connected to and biased by transfer roller power supply 143 to substantially the same potential and polarity as transfer roller 142. Alternatively, and as shown in FIG. 6, conductive brush housing 164 is electrically connected to and biased to the same potential and polarity as transfer roller 142 by a separate power supply 173. It should be particularly noted, however, that power supply 173 must be slaved to or closely follow the power output of transfer roller power supply 143 in order to ensure that conductive brush housing 164 and transfer roller 142 are maintained at the same potential.

In either of the embodiments described above and shown in FIGS. 3 and 6, conductive brush housing 164 is charged to substantially the same magnitude and polarity as transfer roller 142. Thus, the image-degrading flow of transfer current from transfer roller 142 to conductive brush 152 and/or brush housing 164 is substantially reduced.

More particularly, a certain amount of transfer current $I_{TRANS}$ is required to achieve a high-quality and efficient transfer of the developed image from dielectric member 12 to the image substrate. Transfer current $I_{TRANS}$ is, for example, typically from approximately 40 to approximately 60 microamperes. However, engaging and/or cleaning biased transfer roller 142 with conductive transfer roller cleaning brush 152 will cause transfer current $I_{TRANS}$ to be reduced by a cleaning current $I_{CLEAN}$ that flows from transfer roller 142 through conductive transfer roller cleaning brush 152. Cleaning current $I_{CLEAN}$ can be as high as, for example, 30-40 microamperes. Transfer current $I_{TRANS}$ is thus reduced by the cleaning current $I_{CLEAN}$, and poor-quality image transfer may therefore result. Biasing brush housing 164 to substantially the same magnitude and polarity as transfer roller 142 substantially reduces the magnitude of cleaning current $I_{CLEAN}$ and thereby acts to maintain transfer current $I_{TRANS}$ at an acceptable level.

Figure 7:
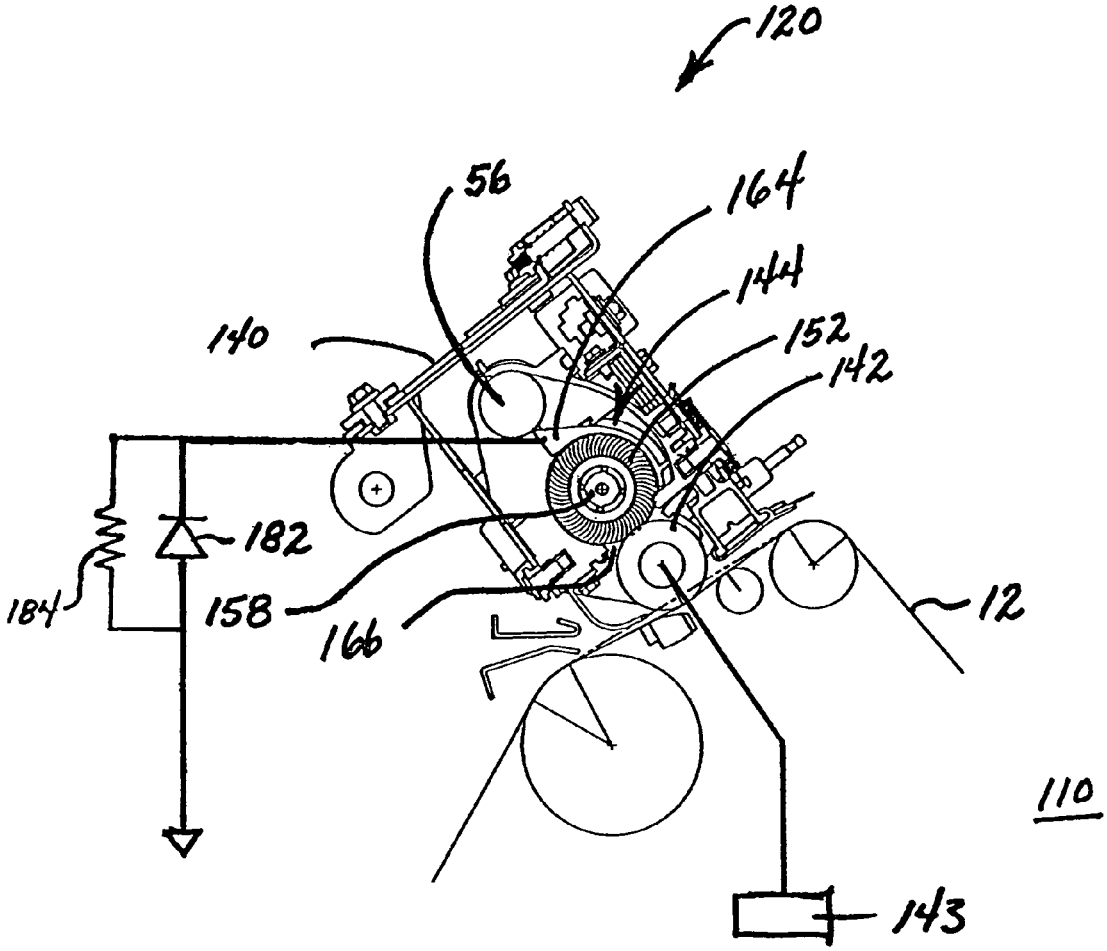
FIG. 7 is a side view of another embodiment of a roller transfer station or sub-system of the present invention.

Referring now to FIG. 7, another embodiment of a roller transfer station of the present invention is shown wherein conductive brush housing 164 is electrically connected to ground through a high-voltage diode 182 in parallel with a current-limiting discharge resistor 184. Diode 182 is, for example, rated at 5 kilovolts and 25 milliamps. One example of such a diode is part number G5FS, available from HV Component Associates of Farmingdale, N.J. Diode 182 permits the conductive brush housing 164 to electrically float and, through contact with or by close proximity to bristles 154 of conductive transfer roller cleaning brush 152, acquire the potential of transfer roller 142. When the polarity of transfer roller 142 is reversed (i.e., from positive to negative in the exemplary embodiment), such as, for example, during a cleaning cycle of the transfer roller and/or during start up or shut down of machine 110, brush housing 164 is also charged to or acquires that reversed polarity. The reversed polarity of brush housing 164, in turn, forward biases diode 182 which connects brush housing 164 to ground potential, and thereby enables the discharge of brush housing 164.

The resistance value of discharge resistor 184, such as, for example, from approximately one to three gigaohms, is chosen to enable the conductive brush housing 164 to electrically discharge in an acceptable period of time and at an acceptable/safe level of current in emergency shut down situations. In the embodiment of FIG. 7, conductive transfer roller cleaning brush 152 is electrically floating and acquires the same potential as transfer roller 142 through contact with or close proximity to conductive transfer roller 142.

Figure 8:
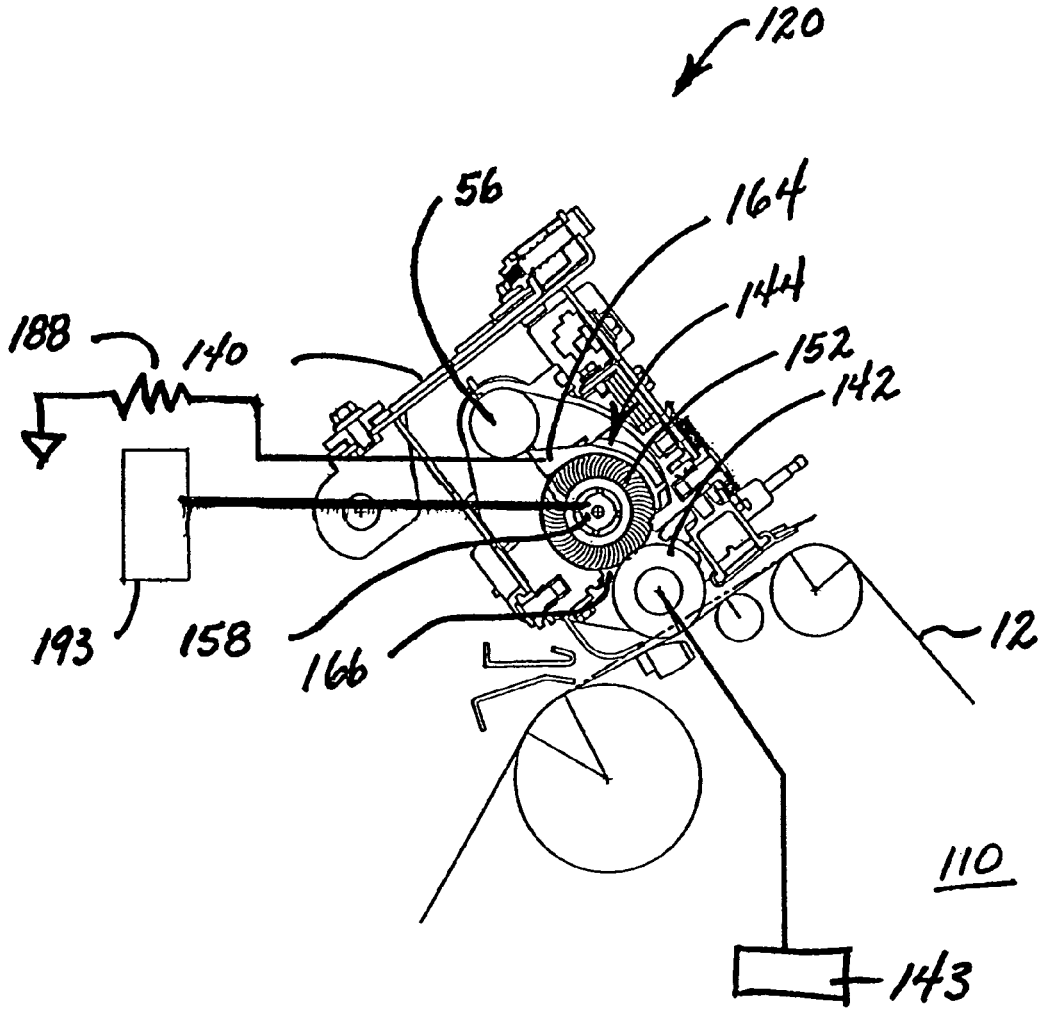
FIG. 8 is a side view of yet another embodiment of a roller transfer station or sub-system of the present invention.

Referring now to FIG. 8, a further embodiment of a roller transfer station of the present invention is shown wherein conductive brush housing 164 is electrically connected to ground potential through a current-limiting resistor 188 and thus is not permitted to float electrically. This embodiment requires that conductive transfer roller cleaning brush 152 be electrically connected to and biased to the same potential as transfer roller 142 by power supply 193, which is separate from transfer roller power supply 143. Power supply 193 supplies the current that will flow from conductive transfer roller cleaning brush 152 to ground through conductive brush housing 164, and thereby prevents any undesirable reduction in the transfer current provided to transfer roller 142 by transfer roller power supply 143 and the adverse affects on image quality that result therefrom.

It should be particularly noted, however, that power supply 193 must be slaved to or closely follow the power output of transfer roller power supply 143 in order to ensure that conductive transfer roller cleaning brush 152 and transfer roller 142 are maintained at the same potential.

It should further be particularly noted that in the configuration wherein each of conductive brush housing 164 and transfer roller cleaning brush 152 are electrically floating and/or isolated they may each be biased to the same potential as transfer roller 142 by the same power supply or separate power supplies, and/or by transfer roller power supply 143.

In all the above-described embodiments of transfer station 120, biased transfer roller 142, conductive transfer roller cleaning brush 152 and conductive brush housing 164 are charged to substantially the same polarity and magnitude thereby preventing the image-degrading affects of the flow of transfer current from transfer roller 142 to conductive transfer roller cleaning brush 152 and/or conductive brush housing 164.

Alternatively, i.e., rather than charging brush housing 164 to substantially the same magnitude and polarity as transfer roller 142, conductive transfer roller cleaning brush 152 is connected to ground or left electrically floating with a path to ground through conductive housing 164, and the transfer current $I_{TRANS}$ provided by transfer roller power supply 143 is increased by an amount approximately equal to the expected cleaning current $I_{CLEAN}$ in order to maintain transfer current $I_{TRANS}$ at a sufficient level and thereby ensure quality image transfer. However, as discussed above, such an approach is less preferred due to the variation in the magnitude of transfer current $I_{TRANS}$ necessary to achieve high-quality image transfer under various operating conditions.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An electrophotographic machine, comprising:

a dielectric member configured for carrying a toner image;

a biased transfer roller engaging said dielectric member and being configured for transferring the toner image to an image substrate;

a transfer roller cleaning brush having a plurality of bristles engaging said transfer roller, at least some of said bristles being electrically conductive bristles;

an electrically conductive brush housing enclosing said transfer roller cleaning brush, said bristles engaging said brush housing, said brush housing defining an opening through which said bristles contact said transfer roller; and means for electrically charging at least one of said transfer roller cleaning brush and said brush housing to substantially the same electrical potential as said transfer roller during a time when the transfer roller cleaning brush performs a cleaning operation on the biased transfer roller, wherein said means for electrically charging comprises one or more power supplies, wherein one of the one or more power supplies is a transfer roller power supply electrically connected to and biasing said transfer roller, wherein the transfer roller power supply or another of the one or more power supplies is electrically connected to a selected one of said transfer roller cleaning brush and said brush housing, wherein if the selected one of said transfer roller cleaning brush and said brush housing is said brush housing, then the transfer roller cleaning brush is electrically floating, and wherein if the selected one of said transfer roller cleaning brush and said brush housing is said transfer roller cleaning brush, then the brush housing is electrically floating or is connected to ground potential.

2. The electrophotographic machine of claim 1, wherein said selected one of said transfer roller cleaning brush and said brush housing is said brush housing.

3. The electrophotographic machine of claim 1, wherein said selected one of said transfer roller cleaning brush and said brush housing is said transfer roller cleaning brush, said brush housing connected to ground potential through a high-voltage diode in parallel with a resistor.

4. An electrophotographic machine, comprising:

a dielectric member configured for carrying a toner image;

a biased transfer roller engaging said dielectric member and being configured for transferring the toner image to an image substrate;

a transfer roller cleaning brush having a plurality of bristles engaging said transfer roller, at least some of said bristles being electrically conductive bristles;

an electrically conductive brush housing enclosing said transfer roller cleaning brush, said bristles engaging said brush housing, said brush housing defining an opening through which said bristles contact said transfer roller; and means for electrically charging at least one of said transfer roller cleaning brush and said brush housing to substantially the same electrical potential as said transfer roller during a time when the transfer roller cleaning brush performs a cleaning operation on the biased transfer roller, wherein said means for electrically charging comprises a power supply, at least one of said transfer roller cleaning brush and said brush housing being electrically connected to said power supply, and wherein said transfer roller cleaning brush is connected to said power supply, said brush housing is electrically connected to ground potential, and a transfer roller power supply is electrically connected to and biases said transfer roller.

5. An electrophotographic machine, comprising:

a dielectric member configured for carrying a toner image;

a biased transfer roller engaging said dielectric member and being configured for transferring the toner image to an image substrate;

a transfer roller cleaning brush having a plurality of bristles engaging said transfer roller, at least some of said bristles being electrically conductive bristles;

an electrically conductive brush housing enclosing said transfer roller cleaning brush, said bristles engaging said brush housing, said brush housing defining an opening through which said bristles contact said transfer roller; and means for electrically charging at least one of said transfer roller cleaning brush and said brush housing to substantially the same electrical potential as said transfer roller during a time when the transfer roller cleaning brush performs a cleaning operation on the biased transfer roller, wherein each of said transfer roller cleaning brush and said brush housing are electrically floating, said means for electrically charging comprises said conductive bristles of said cleaning brush contacting said biased transfer roller and said brush housing.

6. An image transfer station for an electrophotographic machine, comprising:

a biased transfer roller configured to engage a dielectric member of said machine and to transfer a toner image thereon to an image substrate;

a transfer roller cleaning brush having a plurality of bristles engaging said transfer roller, at least some of said bristles being electrically conductive bristles;

an electrically conductive brush housing enclosing said transfer roller cleaning brush, said bristles engaging said brush housing, said brush housing defining an opening through which said bristles contact said transfer roller; and one or more power supplies configured to bias one of said transfer roller cleaning brush and said brush housing to substantially the same electrical potential as said transfer roller.

wherein one of said one or more power supplies is a transfer roller power supply electrically connected to and biasing said transfer roller, wherein the transfer roller power supply or another of the one or more power supplies is electrically connected to a selected one of said transfer roller cleaning brush and said brush housing, wherein if the selected one of said transfer roller cleaning brush and said brush housing is said brush housing, then the transfer roller cleaning brush is electrically floating, and wherein if the selected one of said transfer roller cleaning brush and said brush housing is said transfer roller cleaning brush, then the brush housing is electrically floating or is connected to ground potential.

7. The image transfer station of claim 6, wherein said selected one of said transfer roller cleaning brush and said brush housing is said brush housing.

8. A cleaning apparatus for a transfer roller of an electrophotographic machine, said cleaning apparatus comprising:

a transfer roller cleaning brush having a plurality of bristles engaging said transfer roller, at least some of said bristles being electrically conductive bristles;

an electrically conductive brush housing enclosing said transfer roller cleaning brush, said bristles engaging said brush housing, said brush housing defining an opening through which said bristles contact said transfer roller; and one or more power supplies configured to bias at least one of said transfer roller cleaning brush and said brush housing to substantially the same electrical potential as said transfer roller, wherein at least one of said transfer roller cleaning brush and said brush housing are configured for being biased to substantially the same electrical potential as said transfer roller during a time when the transfer roller cleaning brush performs a cleaning operation on the transfer roller, and wherein one of said one or more power supplies is a transfer roller power supply electrically connected to and biasing said transfer roller, wherein the transfer roller power supply or another of the one or more power supplies is electrically connected to a selected one of said transfer roller cleaning brush and said brush housing, wherein if the selected one of said transfer roller cleaning brush and said brush housing is said brush housing, then the transfer roller cleaning brush is electrically floating, and wherein if the selected one of said transfer roller cleaning brush and said brush housing is said transfer roller cleaning brush, then the brush housing is electrically floating or is connected to ground potential.

9. A method of cleaning an electrically-biased transfer roller in an electrophotographic machine, comprising:

engaging the transfer roller with bristles of a rotating transfer roller cleaning brush, at least some of said bristles being electrically conductive;

enclosing the transfer roller cleaning brush in an electrically conductive brush housing, the said bristles engaging said brush housing, the bristles engaging the transfer roller through an opening in the brush housing; and biasing at least one of the transfer roller cleaning brush and the brush housing to substantially the same electrical potential as the transfer roller during a time when the transfer roller cleaning brush performs a cleaning operation on the transfer roller, wherein said biasing step comprises biasing the brush housing and electrically floating the cleaning brush which acquires the potential of the transfer roller as a result of contact therewith.

* * * * *

UNITED STATES PATENT AND TRADEMARK OFFICE

CERTIFICATE OF CORRECTION

PATENT NO. : 7,167,662 B2
APPLICATION NO. : 11/038660
DATED : January 23, 2007
INVENTOR(S) : George R. Walgrove, III et al.

It is certified that error appears in the above-identified patent and that said Letters Patent is hereby corrected as shown below:

| | |
|---|---|
| Title page, Column 1, Inventors | Delete "Ronald Auty," and insert -- Ronald E. Auty, --, therefor. |
| Column 9, Line 59 | In Claim 6, delete "roller." and insert -- roller, --, therefor. |

Signed and Sealed this

Twenty-fourth Day of July, 2007

JON W. DUDAS
*Director of the United States Patent and Trademark Office*